US009896225B2

(12) United States Patent
Eto et al.

(10) Patent No.: US 9,896,225 B2
(45) **Date of Patent: *Feb. 20, 2018**

(54) PACKAGING AND FILLING DEVICE, PAPER CONTAINER AND BLANK

(71) Applicant: Tetra Laval Holdings & Finance S.A., Pully (CH)

(72) Inventors: Satoshi Eto, Tokyo (JP); Keiji Yano, Tokyo (JP); Hiroyoshi Kuwata, Tokyo (JP); Takashi Omiya, Tokyo (JP)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/981,802

(22) Filed: Dec. 28, 2015

(65) Prior Publication Data

US 2016/0107772 A1 Apr. 21, 2016

Related U.S. Application Data

(63) Continuation of application No. PCT/JP2014/067025, filed on Jun. 26, 2014.

(30) Foreign Application Priority Data

Jun. 29, 2013 (JP) ..... 2013-137612

(51) Int. Cl.
*B65B 3/02* (2006.01)
*B65D 5/06* (2006.01)
(Continued)

(52) U.S. Cl.
CPC ..... *B65B 3/02* (2013.01); *B65B 3/025* (2013.01); *B65B 43/08* (2013.01); *B65B 43/145* (2013.01);
(Continued)

(58) Field of Classification Search
CPC .... B31B 3/32; B65B 3/02; B65B 3/25; B65B 43/08
(Continued)

(56) References Cited

U.S. PATENT DOCUMENTS 3,412,922 A 11/1966 Miller et al.
5,120,292 A * 6/1992 Ueda ..... B31B 1/00 493/124
(Continued)

FOREIGN PATENT DOCUMENTS

JP 56-064943 A 6/1981
JP U 1582831 7/1984
(Continued)

OTHER PUBLICATIONS

Extended Search Report, in application No. 14817869.2-1708 / 3015371 PCT/JP2014067026, dated Feb. 20, 2017.
(Continued)

*Primary Examiner* — Nathaniel Chukwurah
(74) *Attorney, Agent, or Firm* — Finnegan, Henderson, Farabow, Garrett & Dunner LLP

(57) ABSTRACT

A packaging and filling device, a paper container, and a blank is disclosed, in which the container is substantially protected from permeation leakage from an end surface. The blank for the paper container comprises an upper part, a bottom part, and a cylindrical main body having four side walls and a square cross-section, and is formed by a packaging and filling device. The packaging and filling device comprises a loading unit for retrieving the blank and loading a cylindrical blank, a bottom-part-molding unit for molding the bottom part of the cylindrical blank and obtaining a container, a filling unit for filling the container with a liquid food item from an upper opening, and an upper-part-sealing unit for heat-sealing the upper opening.

2 Claims, 6 Drawing Sheets

(51) Int. Cl.

| | |
|---|---|
| ***B65B 43/08*** | (2006.01) |
| ***B65B 43/14*** | (2006.01) |
| ***B65B 51/10*** | (2006.01) |
| ***B65B 43/18*** | (2006.01) |
| ***B65B 43/22*** | (2006.01) |

(52) U.S. Cl.
CPC ..... *B65B 43/185* (2013.01); *B65B 43/225* (2013.01); *B65B 51/10* (2013.01); *B65D 5/067* (2013.01)

(58) Field of Classification Search
USPC ..... 53/456, 565; 299/137, 184; 493/133
See application file for complete search history.

(56) References Cited

U.S. PATENT DOCUMENTS

| | | | | |
|---|---|---|---|---|
| 5,324,250 | A * | 6/1994 | Janson | B65B 3/025 493/133 |
| 5,845,840 | A * | 12/1998 | Johansson | B65D 5/061 229/104 |
| 6,253,994 | B1 * | 7/2001 | Mogard | B29C 66/004 229/125.04 |
| 6,328,204 | B1 | 12/2001 | Stacy-Ryan | |
| 7,147,145 | B2 * | 12/2006 | Kortsmit | B65D 5/067 229/137 |
| 7,571,846 | B2 * | 8/2009 | Berglin | B65D 5/746 229/125.04 |
| 2005/0060965 | A1 | 3/2005 | Katsumata et al. | |
| 2011/0294637 | A1 | 12/2011 | Muller et al. | |

FOREIGN PATENT DOCUMENTS

| | | | |
|---|---|---|---|
| JP | 03-182330 | A | 8/1991 |
| JP | H03-182330 | A | 8/1991 |
| JP | H06-226884 | A | 8/1994 |
| JP | H07-040971 | A | 2/1995 |
| JP | H09-226884 | A | 9/1997 |
| JP | 10-329243 | A | 12/1998 |
| JP | 2000-127260 | A | 5/2000 |
| JP | 2000-2841375 | A | 10/2000 |
| JP | 2001-031018 | A | 2/2001 |
| JP | 2001-353790 | A | 12/2001 |
| JP | 2007-283766 | A | 11/2007 |

OTHER PUBLICATIONS

Supplemental Search Report, in application No. 14817869.2-1708 / 3015371 PCT/JP2014067026, dated Feb. 20, 2017.
Internationai Search Report in PCT/JP2014/067025, dated Sep. 22, 2014 (6 pages).
International Search Report in PCT/JP2014/067026, dated Sep. 22, 2014 (6 pages).

* cited by examiner

PACKAGING AND FILLING DEVICE, PAPER CONTAINER AND BLANK

CROSS-REFERENCE TO RELATED APPLICATION

This application is a continuation application of International Application No. PCT/JP2014/067025 filed on Jun. 26, 2014. The content of the prior application is herein incorporated by reference in its entirety.

TECHNICAL FIELD

The present invention relates to a packaging and filling device, a paper container and a blank for use in packaging and filling liquid food, such as milk, juices, etc. in a roofed paper container.

BACKGROUND ART

The roofed paper container filled with liquid is formed by preparing a bottomed square cylindrical container formed of a paper packaging material having a thermoplastic resinous layer provided on the outside and inside surfaces; standing the container vertically with the container bottom positioned below and the container opening positioned upper; sterilizing the inside of the container; filling a content liquid as a drink, such as milk, a juice or others through an opening in the top of the container; applying hot blast to the part-to-be-hermetically sealed of the inside of the top of the container to soften/melt the thermoplastic resinous layer; and pressing the part-to-be-hermetically sealed to hermetically seal the top opening. The series of these steps (preparing the container, standing the container, the sterilization, filling a liquid, hermetically-sealing the upper part, etc.) is performed inside the packaging/filling device.

In the above-described packaging/filling, a blank in a square cylindrical developed shape (FIG. 1(A)) is formed into a cylinder with a vertical seal, and then the bottom is folded in to form the bottom by thermal press, and the square cylindrical container is formed (FIG. 1(D)). The roofed paper container (FIG. 1(E)) is formed by the series of the above-described steps.

In the packaging and filling device, a blank of a paper container having the developed shaped and the fold lines as illustrated in FIG. 1(A) is used. The blank has a first bottom panel 1*b* and a third bottom panel 3*b* extended from the respective lower sides of a first panel 1 and a third panel 3 which correspond to one pair of 2 opposed container sidewalls; a second bottom panel bottom panel 2*b* and a fourth bottom panel 4*b* extended from the respective lower sides of a second panel 2 and a fourth panel 4 which correspond to the other pair of 2 opposed sidewalls; a fifth panel 6 extended from a part of the lower side of the third bottom panel 3*b*; and plural upper panels it, 2*t*, 3*t*, 4*t* which correspond to the top of the container. In the packaging and filling device, for example, the prior bending mechanism is not used, and the sixth panel is bent with a bending member having 2 curved portions in the step of forming the bottom of the container after the heating step of heating to melt and soften the thermoplastic resinous layer of polyethylene or others on the inside and the outside surfaces (refer to, e.g., Patent Reference 1).

The sixth panel is bent to cover the lower surface of the paper packaging material exposed on the inside surface of the container bottom to thereby protected from permeation leakage.

PRIOR ART REFERENCES

Patent References

Patent Reference 1: Japanese Patent Laid-Open H06-226884

Patent Reference 2: Japanese Patent Laid-Open H09-226884

Patent Reference 3: Japanese Patent Laid-Open H03-182330

Patent Reference 4: Japanese Patent Laid-Open H07-040971

Patent Reference 5: Japanese Utility Model Laid-Open S48-13058

Patent Reference 6: Japanese Utility Model Registration No. 1582831

Patent Reference 7: Japanese Utility Model Laid-Open $63-13144

SUMMARY OF THE INVENTION

Problems to be Solved by the Invention

When the sixth panel is bent with the bending member in the bottom forming step after the heating step of heating to melt and soften the polyethylene layer on the inside and the outside surfaces, the polyethylene on the inside and the outside surfaces of parts or the entire of the sixth panel is also melted and softened, and there is a risk that the polyethylene might adhere to the parts where the bending member contacts and deposit on the bending member in polyethylene masses and residues. Even when the sixth panel is bent, the bent part cannot sufficiently secure a length necessary to protect the side surface of the packaging material. To ensure the sufficient length, increasing the width of the sixth panel might cause the inconvenience that the sixth panel could not be sufficiently bent.

The present invention aims to provide a packaging/filling device, a paper container and a blank which is suitably applicable to the permeation leakage at the lower surface.

Means for Solving the Problem

A packaging and filling device according to the present invention is characterized by the packaging and filling device for forming a paper container including a cylindrical body having 4 sidewalls and a substantially square cross section, a top and a bottom, the paper container being formed of a blank prepared by cutting a band-shaped packaging material made at least of an outermost thermoplastic layer, a paper layer and an innermost thermoplastic layer; the blank having a developed shape of the paper container and fold lines; the blank including a first bottom panel and a third bottom panel extended the respective lower sides of a first panel and a third panel which are one pair of 2 container sidewalls opposed to each other; and a second bottom panel and a fourth bottom panel extended from the respective lower sides of a second panel and a fourth panel which are the other pair of 2 container sidewalls opposed to each other; the third bottom panel having a sixth panel partially extended from the center of the lower side of the third bottom panel; the sixth panel having a width which is 15-65% of a total length of the lower side of the third bottom panel, and a length necessary to delay the permeation leakage from the side surface; the blank including a plurality of top panels corresponding to the top of the paper container; the bottom of the paper container being formed by extending the sixth panel from the lower side of the third bottom panel; bending the second bottom panel and the fourth panel into triangular flaps with the lower side surfaces of the second and the fourth bottom panels faced outward and bending the flaps inward; laying the first bottom panel and the third bottom panel on the outsides of the second bottom panel and the fourth bottom panel with the first bottom panel positioned outside of the third bottom panel, and pressing from the inside and the outside, and heat-sealing; the packaging and filling device at least including a loading means of taking out 1 out of a bundle of a plurality of blanks having vertically sealed and flattened; a bottom forming means of forming the bottom of the cylindrical blank to form the container having the top opening and the bottom; a filling means of filling liquid food through the top opening; and a top sealing means of heat-sealing the top opening; the loading means including a taking-out means which takes out the blank; an erecting means of erecting the flattened blank into the cylindrical blank; and an infeeder which inserts the mandrel of the bottom forming means into the cylindrical blank, and the press station of the bottom forming means including a triangular emboss which presses the container bottom from the outside and the inside by the forward side surface of the mandrel and a press surface and is provided on the forward edge surface of the mandrel at a position where the third bottom panel is exposed on the inside surface of the container.

A paper container according to the present invention is characterized by the paper container having a cylindrical body having 4 sidewalls and a substantially square cross-section, and a top and a bottom, to be formed by a packaging and filling device, the paper container being formed of a blank prepared by cutting a band-shaped packaging material formed at least of an outermost thermoplastic layer, a paper layer and an outermost thermoplastic layer; the blank having a developed shaper of the paper container and fold lines; the blank including a first bottom panel and a third bottom panel extended the respective lower sides of a first panel and a third panel which are one pair of 2 container sidewalls opposed to each other; and a second bottom panel and a fourth bottom panel extended from the respective lower sides of a second panel and a fourth panel which are the other pair of 2 container sidewalls opposed to each other; the third bottom panel having a sixth panel partially extended from the center of the lower side of the third bottom panel; the sixth panel having a width which is 15-65% of a total length of the lower side of the third bottom panel, and a length necessary to delay the permeation leakage from the side surface; the blank including a plurality of top panels corresponding to the top of the paper container; the bottom of the paper container being formed by bending the sixth panel outward; bending the second bottom panel and the fourth panel into triangular flaps with the lower side surfaces of the second and the fourth bottom panels faced outward and bending the flaps inward; laying the first bottom panel and the third bottom panel on the outsides of the second bottom panel and the fourth bottom panel with the first bottom panel positioned outside of the third bottom panel, and pressing from the inside and the outside, and heat-sealing; the packaging and filling device at least including a loading means of taking out 1 out of a bundle of a plurality of blanks having vertically sealed and flattened; a bottom forming means of forming the bottom of the cylindrical blank to form the container having the top opening and the bottom; a filling means of filling liquid food through the top opening; and a top sealing means of heat-sealing the top opening; the loading means including a taking-out means which takes out the blank; an infeeder which inserts the mandrel of the bottom forming means into the cylindrical blank; and the press station of the bottom forming means including a triangular emboss which presses the container bottom from the outside and the inside by the forward side surface of the mandrel and a press surface and is provided on the forward edge surface of the mandrel at a position where the third bottom panel is exposed on the inside surface of the container.

A blank according to the present invention is characterized by the blank for a paper container having a cylindrical body having 4 sidewalls and a substantially square cross-section, and a top and a bottom to be formed by a packaging and filling device, the paper container being formed of a blank prepared by cutting a band-shaped packaging material formed at least of an outermost thermoplastic layer, a paper layer and an outermost thermoplastic layer; the blank having a developed shaper of the paper container and fold lines; the blank including a first bottom panel and a third bottom panel extended the respective lower sides of a first panel and a third panel which are one pair of 2 container sidewalls opposed to each other; and a second bottom panel and a fourth bottom panel extended from the respective lower sides of a second panel and a fourth panel which are the other pair of 2 container sidewalls opposed to each other; the third bottom panel having a sixth panel partially extended from the center of the lower side of the third bottom panel; the sixth panel having a width which is 15-65% of a total length of the lower side of the third bottom panel, and a length necessary to delay the permeation leakage form the side surface; the blank including a plurality of top panels corresponding to the top of the paper container; the bottom of the paper container being formed by extending the sixth panel from the lower side of the third bottom panel, bending the second bottom panel and the fourth panel into triangular flaps with the lower side surfaces of the second and the fourth bottom panels faced outward and bending the flaps inward; laying the first bottom panel and the third bottom panel on the outsides of the second bottom panel and the fourth bottom panel with the first bottom panel positioned outside of the third bottom panel, and pressing from the inside and the outside, and heat-sealing; the packaging and filling device at least including a loading means of taking out 1 out of a bundle of a plurality of blanks having vertically sealed and flattened; a bottom forming means of forming the bottom of the cylindrical blank to form the container having the top opening and the bottom; a filling means of filling liquid food through the top opening; and a top sealing means of heat-sealing the top; the loading means including a taking-out means which takes out the blank; an erecting means of erecting the flattened blank into the cylindrical blank; and an infeeder which inserts the mandrel of the bottom forming means into the cylindrical blank; and the press station of the bottom forming means including a triangular emboss which presses the container bottom from the outside and the inside by the forward side surface of the mandrel and a press surface and is provided on the forward edge surface of the mandrel at a position where the third bottom panel is exposed on the inside surface of the container.

Effects of the Invention

The invention of the above-described constitution makes the following operational functions and produced advantageous effect.

The packaging and filling device according to the present invention, the paper container provided by the packaging and filling device, and the blank used in the packaging and filling device form a paper container having 4 sidewalls and a substantially square cross-section, and a top and a bottom.

The paper container having the top of a roof-shaped configuration is a roof-shaped paper container and can be filled with liquid food, such as milk, juices, etc.

The paper container is formed of a blank prepared by cutting a band-shaped packaging material formed at least of an outermost thermoplastic layer, a paper layer and an innermost thermoplastic layer.

The outermost layer and the innermost layer are formed of a thermoplastic material, such as polyethylene, and are melted and softened by heating ti be heat-sealed by being pressed against each other.

The blank has a developed shape of the paper container and fold lines.

The blank is prepared by cutting the band-shaped packaging material in the developed shaped of the paper container and is vertically seals into the cylindrical body. The band-shaped packaging material is beforehand provided with the fold lines by forming linear embosses at the to-be-bent lines.

The blank has a first bottom panel and a third bottom panel extended the respective lower sides of a first panel and a third panel which are one pair of 2 container sidewalls opposed to each other, and a second bottom panel and a fourth bottom panel extended from the respective lower sides of a second panel and a fourth panel which are the other pair of 2 container sidewalls opposed to each other. The third bottom panel has a sixth panel partially extended from the center of the lower side of the third bottom panel. The blank has a plurality of top panels corresponding to the top of the paper container.

The first panel, the second panel, the third panel and the fourth panel are jointed sequentially adjacent to each other, and by vertically sealing the first panel and the fourth panels, a cylindrical body having 4 sidewalls and a substantially square cross-section can be formed. For the vertical seal, the fifth panel extended from the side edge of the fourth panel can be provided.

The respective bottom panels are folded, and the container bottom can be formed. The respective upper panels are folded, and the top of the container can be formed.

As a characteristic of the present invention, the sixth panel has a width of 15-65%, preferably 20-60%, more preferably 30-55% of the total length of the lower side, and a height (length) which is necessary to delay the permeation leakage from the lower surface.

The sixth panel is extended from the lower side of the third bottom panel, whereby the side surface at the center of the lower side of the third bottom panel is covered by the sixth panel along the length corresponding to the width of the sixth panel, and the length is a length (distance) necessary to delay the permeation leakage, and the container can be substantially protected from the permeation leakage.

As will be described below, the second bottom panel and the fourth bottom panel are formed into triangular flaps with the lower sides of the second and the fourth panels faced outward and bent inward, and on the inside of the container bottom surface, geometrically, the center of the lower side of the third bottom panel alone is exposed. However, the packaging material is formed mainly of paper, and the exposed part is often expanded, dislocated or deflected. In the present invention, the inside of the container bottom surface can be protected from the expansion, dislocation, deflection, etc. in the wide width corresponding to the total length of the lower side of the third bottom panel, and the container can be highly reliable.

In forming the bottom of the paper container, the sixth panel is extended from the lower side of the third bottom panel, and the second bottom panel and the fourth bottom panel are formed into triangular flaps with the lower side surfaces of the second and the fourth bottom panels faced outward and bent inward.

The sixth panel is extended from the lower side of the third bottom panel, and even with the side surface of the sixth panel exposed inside the container, sixth panel is long enough to delay the permeation leakage.

The second bottom panel and the fourth bottom panel are formed into triangular flaps with the lower side surfaces of the second and the fourth bottom panels faced outward and bent inward, whereby the lower side surfaces of the second and the fourth bottom panels are prevented from exposing inside the container.

In forming the bottom of the paper container, with the first bottom panel being outside the third bottom panel, the first bottom panel and the third bottom panel are laid on the outside of the second bottom panel and the fourth bottom panel.

The outsides of the second bottom panel and the fourth bottom panel are covered by the first bottom panel and the third bottom panel, whereby the outside surfaces of the second bottom panel and the fourth bottom panel can be protected by the first bottom panel ad the third bottom panel. Furthermore, the first bottom panel is outside the third bottom panel, whereby the side surface of the third bottom panel can covered and protected by the first bottom panel. On the outside of the container bottom, only a minimum side surface, i.e., the lower side surface of the first bottom panel is exposed on the outside of the container.

The outermost layer and the innermost layer are formed of a thermoplastic material, such as polyethylene or others, which permits the bottom to be pressed from the inside and the outside to be heat-sealed.

The packaging and filling device at least including a loading means of taking out 1 out of a bundle of a plurality of blanks having vertically sealed and flattened; a bottom forming means of forming the bottom of the cylindrical blank to form the container having the top opening and the bottom; a filling means of filling liquid food through the top opening; and a top sealing means of heat-sealing the top opening.

In the packaging and filling device, a blank, which is a material of the paper container, is supplied, the bottom is formed, a liquid is filled into the container, the top is sealed, and the paper container is manufactured.

The loading means takes out 1 blank out of a supplied bundle of a plurality of blanks vertically sealed and flattened.

The loading means supplies a bundle of a plurality of blanks vertically sealed and flattened. One flattened blank is taken out of a bundle of blanks, blanks. The blank taken out is formed cylindrical to be loaded to the next step.

The bottom forming means forms the bottom of the cylindrical blank, and the container having the top opening and the bottom is formed.

The bottom forming means specifically includes a plurality of mandrels radially provided on a rotary shaft; a mandrel is inserted into a container through the top opening; while the mandrel is intermittently rotated, the container bottom on the outer side of the mandrel is heated; the bottom panels are folded; the container bottom is pressed by the forward surface of the mandrel and he pressing surface from the outside and the inside; and the container having the top opening and bottom can be formed.

The filling means fills liquid food, such as milk, juices, etc., through the top opening.

The container has the sidewalls and the bottom already formed, and can be without failure filled with liquid food, such as mil, juices, etc.

The upper sealing means heats and press the top opening of the container, and can be heat sealed.

The packaging and filling device can include, as required, a sterilization means for sterilizes the inside surfaces and the inside of the container with a steriliztion agent such as hydrogen peroxide liquid or others, or a high energy beam, such as ultraviolet ray, electron beam or others; a prior heating means for facilitating the heat-seal, a nitrogen gas replacing means for the upper void of the contained filled with liquid food, or others.

The loading means includes a taking-out means for taking out a blank, an erecting means for erecting a flat blank into a cylindrical blank; and an infeeder for inserting a mandrel of the bottom forming means into the cylindrical blank.

The erecting means can erect a flat blank into a cylindrical blank.

In the infeeder includes a mandrel of the bottom forming means is inserted into the cylindrical blank.

The infeeder includes an endless chain, and on the chain, a carrier which is moved together with the sixth panel of the cylindrical blank is provided, and as the carrier is moved downward, the carrier departs from the cylindrical blank and the sixth panel.

The press station of the bottom forming means includes a triangular emboss which presses the container bottom from the outside and the inside by the forward side surface of the mandrel and a press surface and is provided on the forward side surface of the mandrel at the position where the third bottom panel is exposed on the inside surface of the container.

The triangular flaps of the second and the fourth bottom panels make a triangular step on the insider surface of the container. The triangular emboss is trapped in the triangular step and presses the third bottom panel, and the seal can be made further uniform.

As described above, a packaging and filling device, paper container and a blank which is suitably applicable to the permeation leakage from the side surface.

BRIEF DESCRIPTION OF THE DRAWINGS

FIG. 1(A) is a plan view of the developed shape of a blank of the paper container, FIG. 1(B) is a plan view of the blank vertically sealed and flattened, FIG. 1(C) is the cylindrical blank, FIG. 1(D) is a perspective view of the empty container having the top opening opened and the bottom formed, and FIG. 1(E) is a perspective view of the paper container filled and sealed.

MODE FOR CARRYING OUT THE INVENTION

An embodiment of the present invention will be described below in good detail with reference to the attached drawings.

Figure 1:
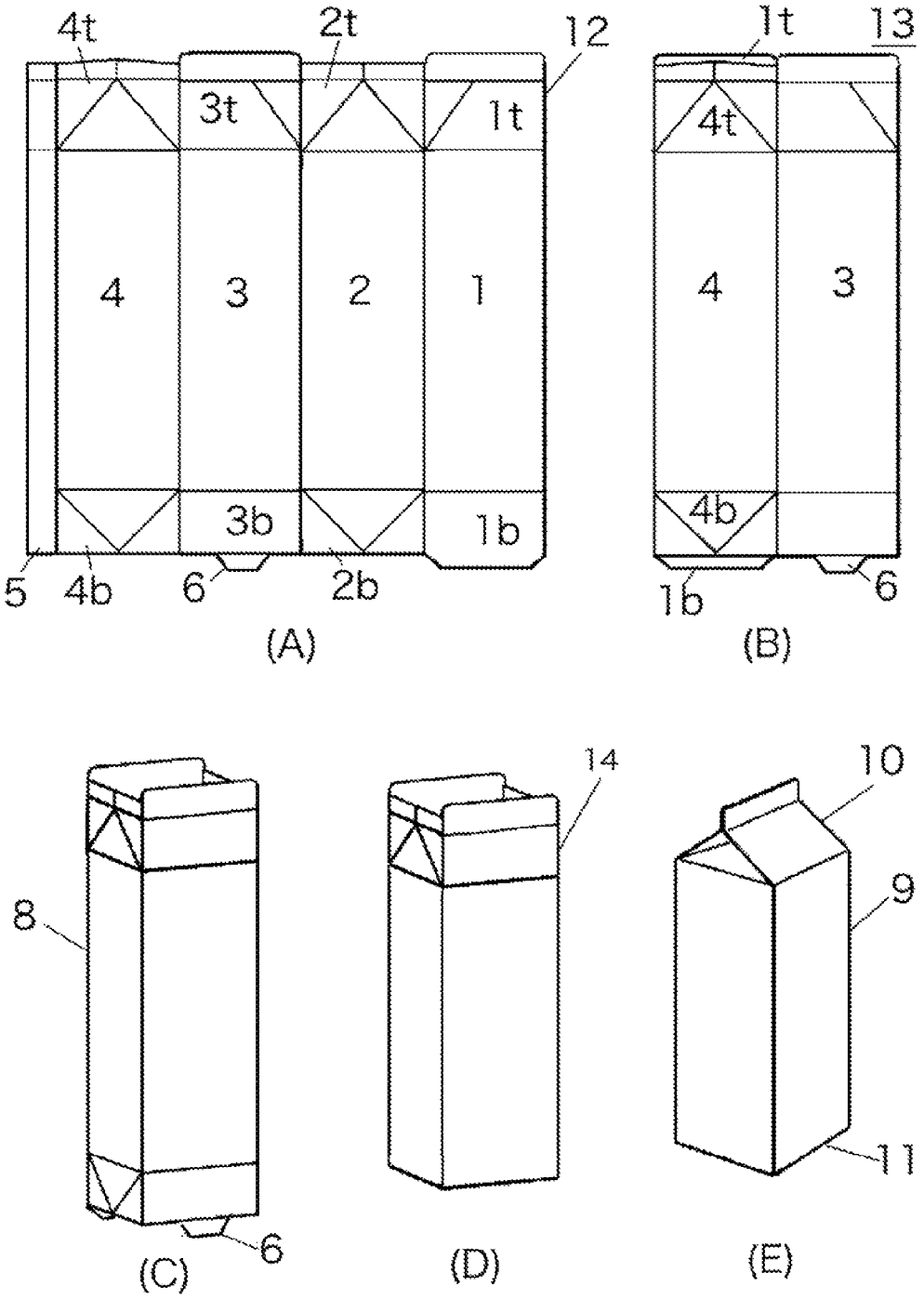
FIG. 1 illustrates the paper container usable in the present invention.

In this embodiment, a paper container 9 having, as illustrated in FIGS. 1(C) and 1(E), a cylindrical body 8 of a substantially square cross-section having 4 side walls, and a top 10 and a bottom 11 is formed.

The paper container having the top in a roofed configuration is a roof-shaped paper container, and can package and be filled with liquid food, such as milk, a juice or others.

The ordinary paper container of a capacity of 1 litter has the dimensions of a 73 mm one side of the square and a 234 mm-height of the container.

The paper container 9 is formed from a blank 12 prepared by cutting a band-shaped packaging material formed of an outermost thermoplastic layer, a paper layer and an innermost thermoplastic layer in the sequence of FIGS. 1(A), 1(B), 1(C), 1(D) and 1(E).

The outermost layer and the innermost layer are formed of a heat-sealable material for polyethylene, and are melted and softened by heating, and pressed on each other, and heat-sealed.

As illustrated in FIG. 1(A), the blank 12 has the developed shape of the paper container 9 and plural fold lines.

The blank 12 is formed by cutting the band-shaped packaging material (not illustrated) into the developed shape of the paper container 9. The blank 12 is vertically sealed into a cylindrical body. The fold lines are formed by linearly embossing the band-shaped packaging material in advance along the lines-to be-folded (the fold lines).

As illustrated in FIG. 1(A), the blank 12 has a first bottom panel 1*b* and a third bottom panel 3*b* extended from the respective lower sides of a first panel 1 and a third panel 3 which correspond to one pair of 2 opposed container sidewalls, and a second bottom panel 2*b* and a fourth bottom panel 4*b* extended from the respective lower edges of a second panel 2 and a fourth panel 4 which correspond to the other 2 opposed container sidewalls; the sixth panel 6 partially extended from the center of the lower side of the third bottom panel 3*b*; and plural panels 1*t*, 2*t*, 3*t*, 4*t* which correspond to the top 10 of the container 9.

As illustrated in FIG. 1(A), the first panel 1, the second panel 2, the third panel 3 and the fourth panel 4 are jointed adjacent to each other in the described sequence. The first panel 1 and the fourth panel 4 are vertically sealed to thereby form a cylindrical body having 4 sidewalls and a substantially square cross-section. For the vertical seal, a fifth panel 5 is provided, extended from the side of the fourth panel.

FIG. 1(B) illustrates the blank 13 in the cylindrical body having the fifth panel 5 vertically sealed, which is flattened.

Figure 3:
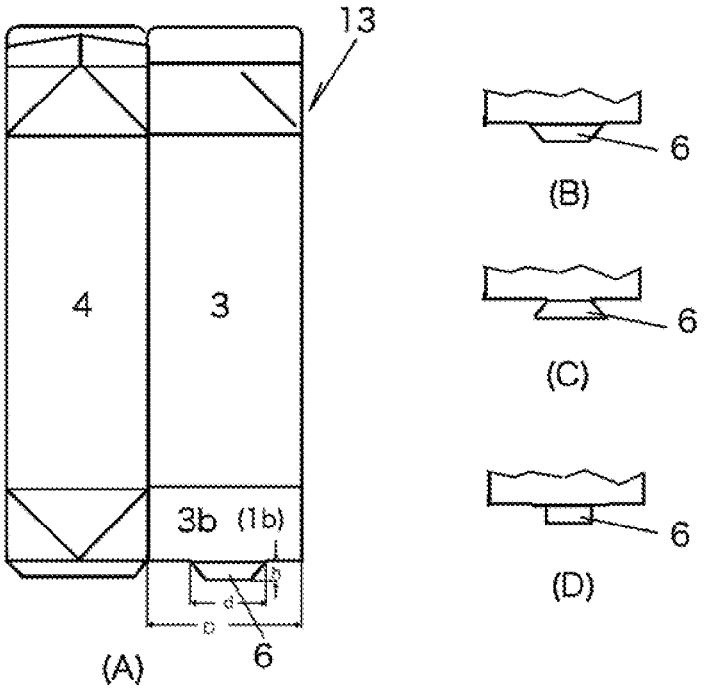
FIG. 3 is a plan view of the blank usable in the present invention vertically sealed and flattened (A) and partial plan views of variations of the sixth pane (B), (C) and (D).

This embodiment is characterized in that as illustrated in FIG. 3(A), the sixth panel 6 has a width d which is 15-65% of a total length of the lower side of the third bottom panel, preferably 20-60%, more preferably 30-65%, and a height h which facilitates the bend.

The specific dimensions of the sixth panel 6 depend on the container capacity (1 side of the container). For example, when one side is 73 mm, the width is, e.g., 20-40 mm. When the width is below the lower limit value excluding the lower limit value, there is a risk that the side surface at the center of the lower side of the third bottom panel 3*b* might be exposed. On the other hand, when the width is over the upper limit value, the thickness of the container bottom increases.

The six panel 6 extended from the lower side of the third bottom panel covers the side surface at the center of the lower side of the third bottom panel along the length corresponding to the width of the sixth panel, and the length (distance) is sufficient to delay the permeation leakage is bent to thereby substantially protect the container from the permeation leakage.

The shape and the dimensions of the sixth panel 6 is exemplified in FIGS. 3(B), 3(C) and 3(D). The shape of the sixth panel 6 is trapezoid, inverse trapezoid, rectangle or others. The shape can be suitably selected and changed.

The height (length) of the sixth panel can be selected and varied suitably corresponding to a period of time necessary to delay the permeation leakage.

As illustrated In FIG. 2A, the second bottom panel 2*b* and the fourth bottom panel 4*b* are formed into triangular flaps with the lower side surfaces faced outward, and bent inward.

Figure 2:
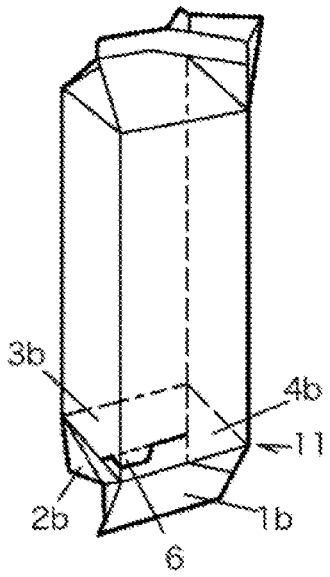
FIG. 2 is a perspective view of the paper container usable in the present invention having the top opened and the bottom dissolved.
Figure 4:
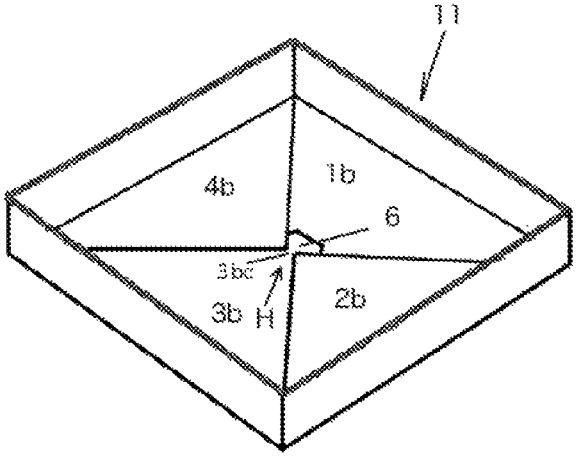
FIG. 4 is a perspective view of the bottom of the sectioned paper container usable in the present invention.

In the design, as illustrated in FIGS. 4 and 2, the center 3*bc* of the lower side of the third bottom panel 3*b* is positioned between the forward edges of the triangular flaps. The packaging material is formed mainly of paper, and actually the exposed part may be widened, dislocated or deflected. In this embodiment, the central lower side 3*bc* is wide enough with respect to the total length of the lower side of the third bottom panel to protect the exposed part from the increase, dislocation, deflection, etc.

As illustrated in FIG. 2, the bottom 11 of the paper container is formed by with the sixth panel 6 being extended, forming the second bottom panel 2*b* and the fourth bottom panel 4*b* into triangular flaps with the lower side surfaces of the second the fourth bottom panels 2*b*, 4*b* faced outward and bending the flaps inward.

As illustrated in FIG. 4, the xith panel 6 is extended long from the lower side of the third bottom panel 3*b*, whereby with the side surface of the sixth panel 6 exposed inside the container, the permeation leakage can be delayed.

As illustrated in FIG. 2, in forming the bottom 11 of the paper container, the first bottom panel 1*b* and the third bottom panel 3*b* are so laid on the outsides of the second bottom panel 2*b* and the fourth bottom panel 4*b* that the first bottom panel 1*b* is on the outside of the third bottom panel 3*b*.

The outsides of the second bottom panel 2*b* and the fourth bottom panel 4*b* are covered by the first bottom panel 1*b* and the third bottom panel 3*b*, whereby the side surfaces of the outsides of the second bottom panel 2*b* and the fourth bottom panel 4*b* are protected by the first bottom panel 1*b* and the third bottom panel 3*b*. Furthermore, the first bottom panel 1*b* is outside the third bottom panel 3*b*, whereby the respective side surfaces of the third bottom panel 3*b* and the sixth panel 6 are covered and protected by the first bottom panel 1*b*. On the outside surface of the container bottom, the lower side surface alone of the first bottom panel is exposed on the outside of the container.

Figure 12:
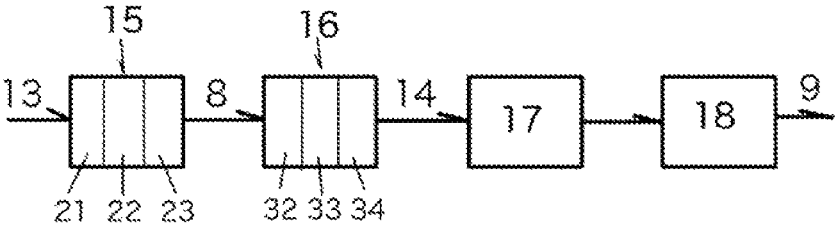
FIG. 12 is a schematic view of an example of the packaging and filling device usable in the present invention.

As illustrated in the schematic view of FIG. 12, the packaging and filling device according to this embodiment comprises a loading means 15 which takes out 1 blank 13 out of a supplied bundle of a plurality of vertically sealed and flattened blanks and loads the cylindrical blank 8; a bottom forming means 16 which forms the bottom of the cylindrical blank 8 to prepare a container 14 having the top opening and the bottom; a filling means 17 which fills liquid food through the top opening; and a top sealing means 18 which heat-seals the top opening.

In the packaging and filling device, a blank 13 of a cylindrical body of a paper container material, which is vertically sealed and flattened is loaded, the container bottom 11 is formed, a liquid is filled in the container, and the top is heat-sealed to manufacture a paper container 9.

The loading means 15 takes out 1 blank 13 out of a supplied bundle 20 of a plurality blanks vertically sealed and flattened and loads the cylindrical blank 8 in the bottom forming means 16.

The loading means 15 includes a taking-out means 21 which takes out a blank 13; an erecting means 22 which erects the blank 13 flattened into a cylindrical blank; an infeeder 23 which inserts the cylindrical blank into the mandrel of the bottom forming means.

The taking-out means 21 supplies a bundle of a plurality of blanks vertically sealed and flattened and takes out 1 flat blank out of the bundle 20 of blanks, blanks.

As illustrated in FIG. 3(A), the sixth panel 6 of the blank taken out is protruded from the panel of the 2 staked panels of the first bottom panel 1*b* and the third bottom panel 3*b*.

Figure 5:
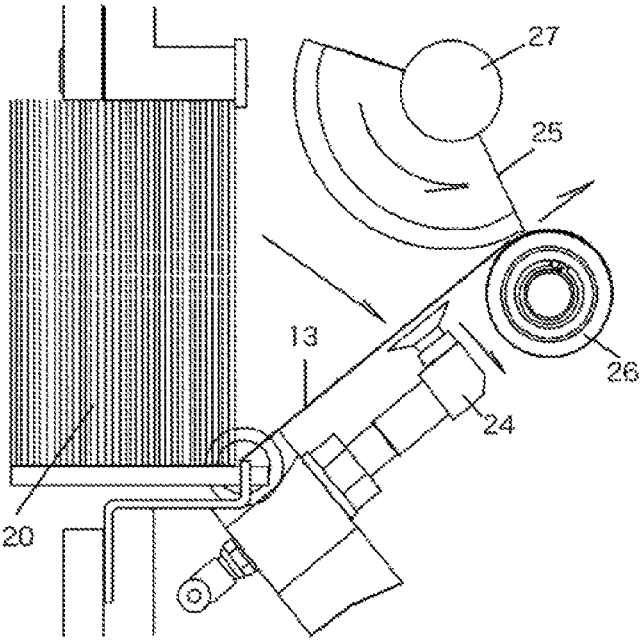
FIG. 5 is a diagrammatic view which illustrates the loading means usable in the present invention taking out, receiving and transferring a blank.
Figure 6:
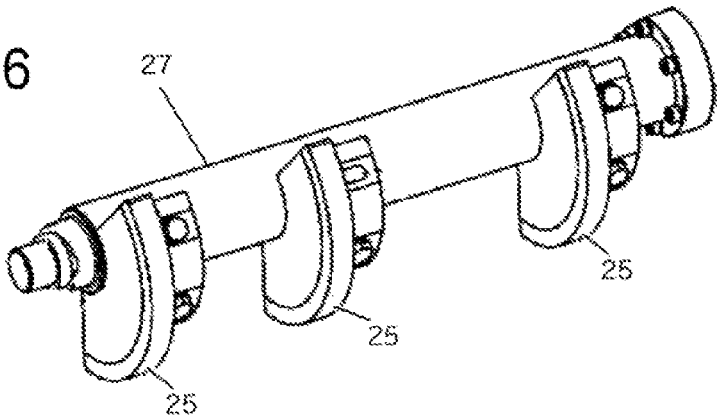
FIG. 6 is a partial perspective view of the rotary roller usable in the present invention, which receives and transfers a blank.

The taking-out means 21 of this embodiment will be described with reference to FIGS. 5 and 6.

The taking-out means 21 includes a suction means 24 which suctions and falls down 1 blank 13 from a bundle 20 with the suction force; and a circular roller 25 and the opposed roller 26 which pinches the edge of the blank 13 to carry the blank 13. In this embodiment, 3 circular rollers 25 are provided on the axis 27 of the rotary roller.

The flattened blank 13 taken out is received by the rotary roller 25 and carries to the next step. The rotary roller 25 senses the position of the blank and rotates the roller to receive the blank, holding the blank together with the opposed roller 26.

The erecting means 22 erects the flattened blank 13 to the cylindrical blank 8 as illustrated in FIG. 1(C).

The infeeder 23 inserts the cylindrical blank 8 with kept the sixth pane foldable into the mandrel of the bottom forming means 16.

Figure 7:
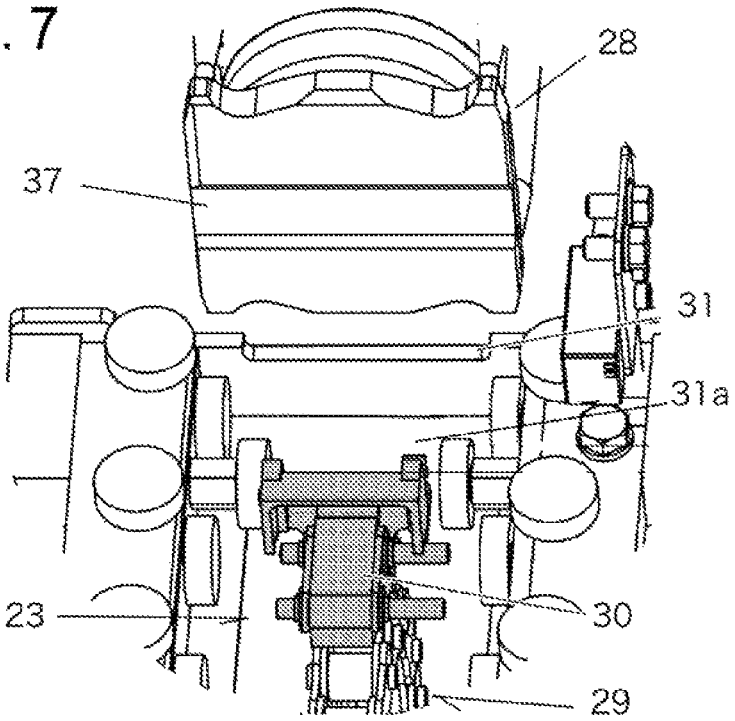
FIG. 7 is a perspective view of the forward edge of the infeeder usable in the present invention.

The perspective view of FIG. 7 illustrates the situation of the forward edge of the infeeder 23 of this embodiment. The forward edge of the feeder conveyor 29 of the infeeder 23 with respect to the mandrel 28 of the bottom forming means 16. A carrier 30 is attached to the feeder conveyor 29. A cylindrical blank 8 (not illustrated in FIG. 7) is positioned in front of the carrier 30 of the feeder conveyor 29, and as the cylindrical blank 8 is moved along the feeder conveyor 29, the carrier 30 follows the cylindrical blank 8. As the cylindrical blank 8*s* transferred to the mandrel 28, the infeeder conveyor 29 goes downward to return to the original position, and resultantly the carrier 30 as well starts to move downward. As the carrier 30 moves downward, the sixth panel as well follows, and then when the feeder conveyor 29 further moves, the carrier 30 departs from the mandrel 28 and the sixth panel 6.

The bottom forming means 16 forms the bottom of the cylindrical blank, and a container 14 having the opening and the bottom.

The bottom forming means 16, in this embodiment, has a plurality of mandrels provided radially on a rotary shaft. The mandrels are engaged into the containers through the top openings; while the mandrels are intermittently rotated, the bottoms of the containers on the outer edges of the mandrels are heated by a heat station 32; the bottom panels are folded by a panel folding station 33; and the container bottoms are pressed from both the inside and the outside by the forward edge surfaces of the mandrels and the press surfaces, and the containers 14 respectively having the top openings and the bottoms are formed.

The bottom forming means 16 transfers blanks by a rotary mandrel assembly having a plurality of mandrels radially directed outward.

The mandrels are turned to the heating station 32 to heat the bottom panels of the blanks by a suitable heating device. This heating device blows hot blast through a nozzle to the bottom panels. The mandrels are turned to the next panel folding station 33 to bent the bottom panels, and at a press station 34, the sealed bottom walls of the containers are formed.

The heater for heating the bottom panels of a container of the heating station 32 of the bottom forming means 16 will be described with reference to FIG. 8 which illustrates a perspective view of the nozzle.

An inner nozzle 35*a* and an outer nozzle 35*b* of the heater respectively blast hot air to the inside surfaces and the outside surfaces of the bottom panels (not illustrated in FIG. 8) to heat them.

The heater approaches the forward edge of the mandrel so that the bottom panel are engaged in the gap between the inner nozzle 35*a* and the outer nozzle 35*b* assembled.

Figure 8:
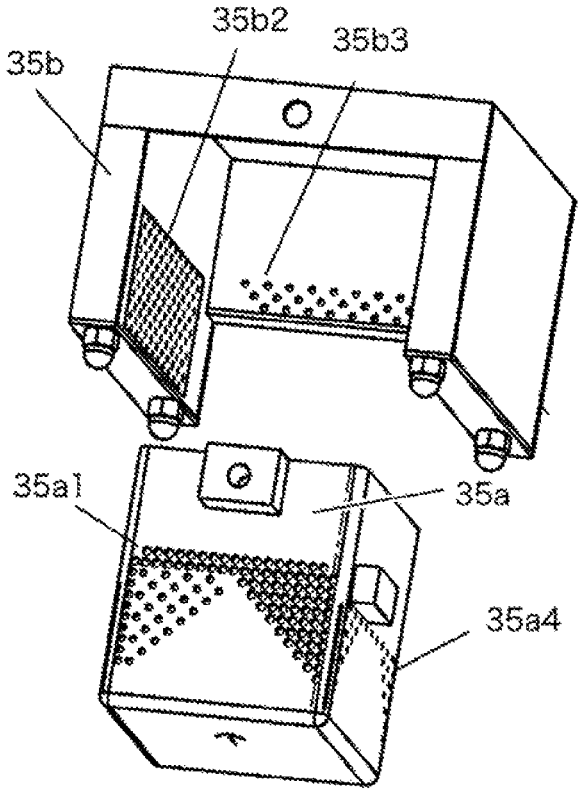
FIG. 8 is a dissolved perspective view of the inside and the outside nozzles of the heater for heating the container bottom panel at the outer forward edge of the mandrel of the bottom forming means usable in the present invention.

In FIG. 8, the inner nozzle 35*al* heats the inside surface of the first bottom panel 1*b*; the inner nozzle 35*a*4 heats the inside surface fo the fourth bottom panel 4*b*; the outer nozzle 35*b*2 heats the outer surface of the second bottom panel 2*b*; and the outer nozzle 35*b*3 heats the inside surface of the third bottom panel 3*b*.

Folding of the bottom panels toward the mandrel forward surface 37 at a panel forming station 33 will be described with reference to FIGS. 8 and 10.

Figure 9:
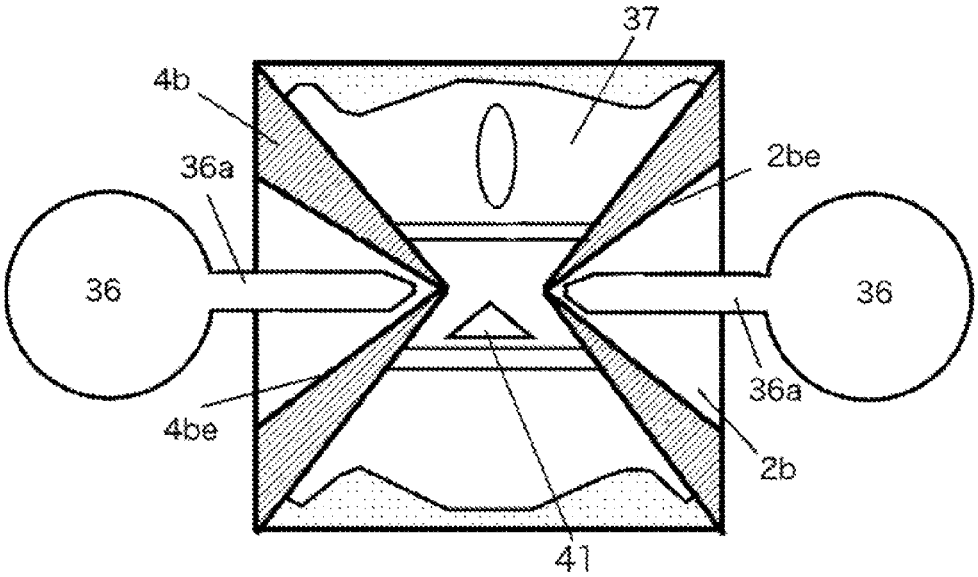
FIG. 9 is a diagrammatic plan view of the bottom forming means usable in the present invention folding the first and the third bottom panels.

In FIG. 9, the second bottom panel 2*b* and the fourth bottom panel 4*b* are formed into triangular flaps by the arms 36*a*, 36*a* of a second and a fourth panel folding members 36, 36 into triangular flaps with the lower edge surfaces 2*be*, 4*be* of the second and the fourth bottom panels 2*b*, 4*b* faced outward and are bent inward by the arms 361, 36*b* of a second and a fourth panel folding members 36, 36.

In FIG. 9, the first bottom panel 1*b* and the third bottom panel 3*b* are not illustrated.

Before the folding of the second bottom panels 2*b* and the fourth bottom panel 4*b* finishes, the folding of the first bottom panel 1*b*, the third bottom panel 3*b* and the sixth panel is started.

Figure 10:
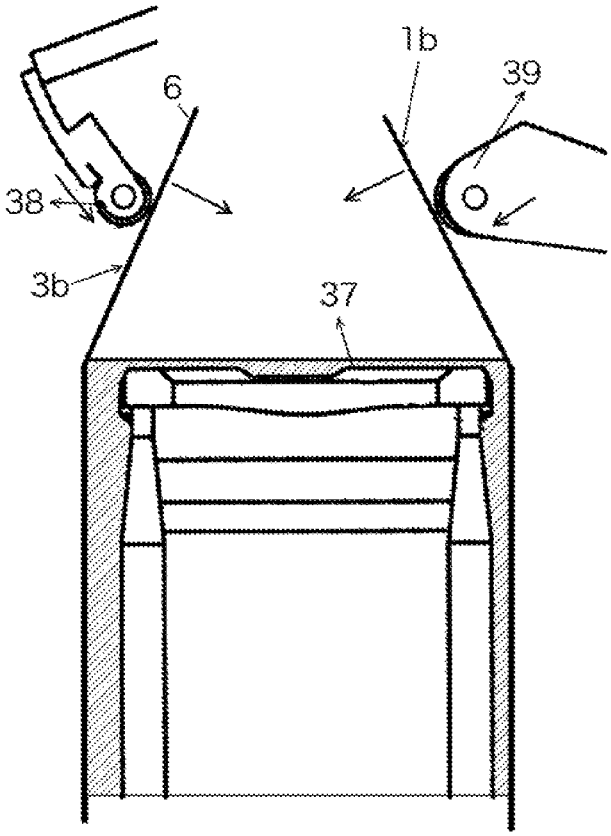
FIG. 10 is a partial sectional side view of the bottom forming means usable in the present invention folding the first and the third bottom panels.
Figure 11:
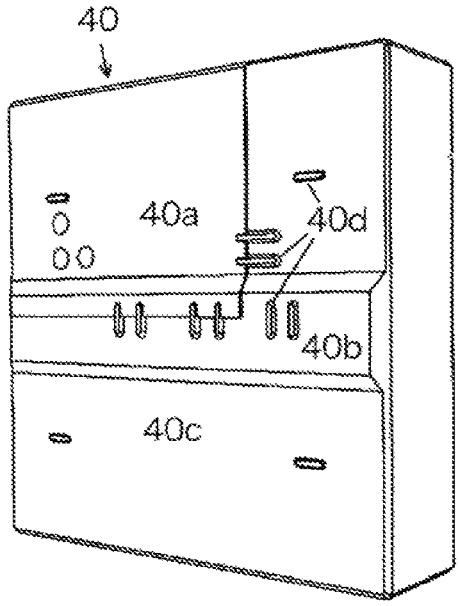
FIG. 11 is a perspective view of the press surface for pressing the container bottom from the outside by the bottom forming means usable in the present invention.

In FIG. 10, the first and the third bottom panels 1*b*, 3*b* are folded by the first panel folding member 36 and the third panel folding member 38 of the bottom forming means. FIG. 10 does not illustrate the second bottom panel and the fourth bottom panel.

In this embodiment, the six panel 6 is extended from the side of the third bottom panel 3*b*.

The third bottom panel 3*b* is laid on the outsides of the second bottom panel 2*b* and the fourth bottom panel 4*b* (not illustrated in FIG. 10) by the third panel folding member 38 so that the first bottom panel 1*b* is outside of the third bottom panel 3*b*.

The first bottom panel 1*b* is folded by the first panel folding member 39 so that the first bottom panel 1*b* is laid on the outside of the third bottom panel 3*b*.

The outsides of the second bottom panel 2*b* and the fourth bottom panel 4*b* are covered by the first bottom panel 1*b* and the third bottom panel 3*b*. The respective side surfaces of the third bottom panel 3*b* and the sixth panel 6 are covered by the first bottom panel 1*b*.

In the press station 34 of the bottom forming means 16, the container bottom 11 is pressed from the outside and the inside thereof by the mandrel forward side surface 37 and the press surface 40.

In this embodiment, the press surface 40 includes a plane 40*a* opposed to the outside surface of the first bottom plane 1*b*, a plane 40*a* opposed to the outside surface of the first bottom panel 1*b*, a plane 40*c* opposed to the outside surface of the third bottom panel 3*b*, a projected surface 40*b* having a flat top surface for forming a wide upward trench in the container bottom 11, and a plurality of embosses 40*d* for reinforcing the seal.

All of the press surfaces 40*a*, 40*b*, 40*c* are flat, and the bottom surface of the container bottom is also free from concavities and convexities.

As illustrated in FIG. 9, the mandrel forward surface has a triangular emboss 41 at the position opposed to the position where the third bottom panel 3*b* is exposed on the inside surface of the container.

Figure 13:
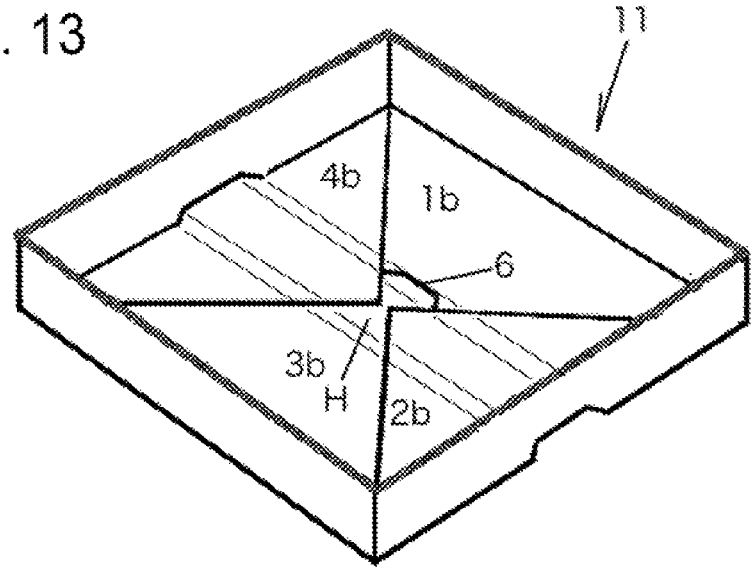
FIG. 13 is a perspective view of the paper container usable in the present invention, which is sectioned at the bottom.

As illustrated in FIG. 4 and FIG. 13, the triangular flaps of the second and the fourth bottom panels 2*b*, 4*b* form a triangular step H on the inside surface of the container. The triangular emboss 42 is trapped in the triangular step H and presses the third bottom panel 3*b*. The central part of the inside surface of the container bottom has steps and discontinuous parts formed, but the embosses are inserted for further uniform pressing.

In this embodiment, the filling means 17 fills liquid food, such as milk, juices, etc., into the container through the opening.

The container has the side walls and the bottom already formed.

In this embodiment, an upper sealing means 18 the top opening of the container 10 is heated and pressed to be heat-sealed.

The packaging and filling device comprises a sterilization means of sterilizing the inside surface and the inside of the container with a sterilization agent, such as hydrogen peroxide liquid or others, or a high energy beam, such as ultraviolet ray, electron beam or others; a prior heating means which facilitates the heat-seal; and a nitrogen gas replacing means which fills nitrogen gas into the upper void of the container filled with liquid food.

As described above, this embodiment provides a packaging and filling device, paper container and blank which is suitably applicable to permeation leakage from the side surface.

The present invention is not limited to the embodiment described above and can be variously modified, based on the concept of the present invention, and the modifications and the variations are not excluded from the scope of the present invention.

INDUSTRIAL APPLICABILITY

The present invention is applicable to the manufacture of packaging/filling liquid food.

REFERENCE NUMBERS

1 first panel
2 second panel
3 third panel
4 fourth panel
6 sixth panel
9 paper container
12, 13 blank

What is claimed is:

1. A packaging and filling device for forming a paper container, the paper container comprising a cylindrical body having a substantially square cross section, four sidewalls, a top, and a bottom, wherein the paper container is formed of a blank prepared by cutting a band-shaped packaging material including an outermost thermoplastic layer, a paper layer, and an innermost thermoplastic layer, the blank further comprising:

a first panel and a third panel, the first panel and third panels being configured to form a first pair of opposing sidewalls of the container;

a second panel and a fourth panel, the second panel and fourth panels being configured to form a second pair of opposing sidewalls of the container;

a first bottom panel and a third bottom panel, the first and third bottom panels extended from respective lower sides of the first panel and the third panel;

a second bottom panel and a fourth bottom panel, the second bottom panel and fourth bottom panels extended from respective lower sides of the second panel and the fourth panel; and a plurality of top panels corresponding to the top of the paper container;

wherein:

the third bottom panel comprises a sixth panel partially extended from a center of the lower side of the third bottom panel; and a width of the sixth panel is 15-65% of a total length of the lower side of the third bottom panel;

wherein the bottom of the paper container is formed by:

extending the sixth panel from the lower side of the third bottom panel;

bending the second bottom panel and the fourth panel into triangular flaps with the lower side surfaces of the second and fourth bottom panels facing outward and bending the flaps inward;

laying the first bottom panel and the third bottom panel on the outsides of the second bottom panel and the fourth bottom panel with the first bottom panel positioned outside of the third bottom panel; and pressing from the inside and the outside of the paper container; and heat-sealing to form a seal;

the packaging and filling device comprising:

a loading unit configured to extract a selected blank from a bundle of a plurality of vertically sealed and flattened blanks;

a bottom forming unit configured to form the bottom of a cylindrical blank to form the container having a top opening and the bottom;

a filling unit configured to fill liquid food through the top opening; and a top sealing unit configured to heat-seal the top opening;

wherein the loading unit further comprises:

an extracting unit configured to extract the blank;

an erecting unit configured to erect the flattened blank into the cylindrical blank; and an infeeder which inserts a mandrel of the bottom forming unit into the cylindrical blank;

wherein the bottom forming unit comprises a press station, the press station comprising a triangular emboss configured to press the container bottom from the outside and the inside of the container by a forward side surface of the mandrel and a press surface, the triangular emboss being provided on a forward edge surface of the mandrel at a position where the third bottom panel is exposed on the inside surface of the container.

2. A packaging and filling device for forming a paper container having a top opening and a bottom, the packaging and filling device comprising:

a loading unit configured to extract a selected blank from a bundle of a plurality of vertically sealed and flattened blanks, the blank comprising a first bottom panel, a second bottom panel, a third bottom panel, and a fourth bottom panel, the loading unit further comprising:

an extracting unit configured to extract the selected blank;

an erecting unit configured to erect the flattened blank into a cylindrical blank; and an infeeder;

a bottom forming unit configured to form a bottom of the cylindrical blank to form the paper container, the bottom forming unit comprising a mandrel and a press station;

a filling unit configured to fill liquid food through the top opening; and a top sealing unit configured to heat-seal the top opening;

wherein:

the infeeder is configured to insert the mandrel into the cylindrical blank;

the press station of the bottom forming unit comprises a triangular emboss configured to press the container bottom from the outside and the inside by a forward side surface of the mandrel and a press surface, the triangular emboss being provided on a forward edge surface of the mandrel at a position where the third bottom panel is exposed on the inside surface of the container; and the press surface comprises:

a projected surface for forming a wide upward trench in the container bottom, and a triangular step H formed on the wide upward trench, the triangular step H being configured to trap the triangular emboss and press the third bottom panel.

* * * * *